US005294071A

United States Patent [19]

Hartel et al.

[11] Patent Number: 5,294,071

[45] Date of Patent: Mar. 15, 1994

[54] ROTATIONALLY DRIVEN BRAKE DISK ARRANGEMENT OF A YARN TENSIONING DEVICE

[75] Inventors: Robert Hartel, Aachen; Karl-Josef Hoehne, Cologne; Ferdinand-Josef Hermanns, Erkelenz; Herbert Henze, Monchen-Gladbach; Herbert Knors, Monchen-Gladbach; Dietmar Engelhardt, Monchen-Gladbach; Wilhelm Zitzen, Monchen-Gladbach; Manfred Veyes, Monchen-Gladbach; Herbert Merkens, Erkelenz; Wolfram Weissenfels, Monchen-Gladbach; Hermann Ruetten, Viersen; Dirk Jaegers; Berndt Pommer, both of Monchen-Gladbach, all of Fed. Rep. of Germany

[73] Assignee: W. Schlafhorst AG & Co., Monchen-Gladbach, Fed. Rep. of Germany

[21] Appl. No.: 943,887

[22] Filed: Sep. 11, 1992

[30] Foreign Application Priority Data

Sep. 12, 1991 [DE] Fed. Rep. of Germany ..... 4130301

[51] Int. Cl.[5] ..... B65H 59/22

[52] U.S. Cl. ..... 242/150 M; 188/156

[58] Field of Search ..... 188/156, 161, 164, 171, 188/83, 166; 66/146; 310/93, 103, 105; 242/150 M

[56] References Cited

U.S. PATENT DOCUMENTS

| | | | |
|---|---|---|---|
| 2,614,773 | 10/1952 | Ammerall | 242/150 M |
| 2,751,166 | 6/1956 | Beyer | 242/150 M |
| 2,907,535 | 10/1959 | Mindheim et al. | 242/150 M |
| 3,053,474 | 9/1962 | Luntz et al. | 242/150 M |
| 3,100,091 | 8/1963 | Mindheim et al. | 242/150 M |
| 3,991,954 | 11/1976 | Schwartz | 242/150 M |
| 4,202,511 | 5/1980 | Koskowski | 242/150 R |
| 4,313,578 | 2/1982 | Van Wilson et al. | 242/149 |

FOREIGN PATENT DOCUMENTS

| | | |
|---|---|---|
| 864073 | 1/1953 | Fed. Rep. of Germany . |
| 2200058 | 9/1973 | Fed. Rep. of Germany . |
| 2954571C2 | 2/1980 | Fed. Rep. of Germany . |
| 636653 | 6/1983 | Switzerland . |

*Primary Examiner*—Robert J. Oberleitner
*Assistant Examiner*—Chris Schwartz
*Attorney, Agent, or Firm*—Shefte, Pinckney & Sawyer

[57] ABSTRACT

The present invention relates to a brake disk arrangement for a yarn tensioning device wherein at least one of a pair of opposed facing brake disks can be acted upon by a variable pressing force in the direction of the other brake disk. According to the present invention, rotary motion is transmitted from one brake disk to the other in a simple manner, without affecting the brake force, by connecting to one of the brake disks a concentric magnet that is secured against relative rotation with respect to this brake disk, and by connecting to the other brake disk a concentrically arranged body of hysteresis material which is secured against relative rotation with that brake disk. At least the brake disk that can be acted upon the variable pressing force comprises a nonmagnetic material and is changeable in position axially relative to the magnet or the hysteresis material associated with the disk. In alternate embodiments, both brake disks may be provided with a magnet.

7 Claims, 3 Drawing Sheets

FIG.1
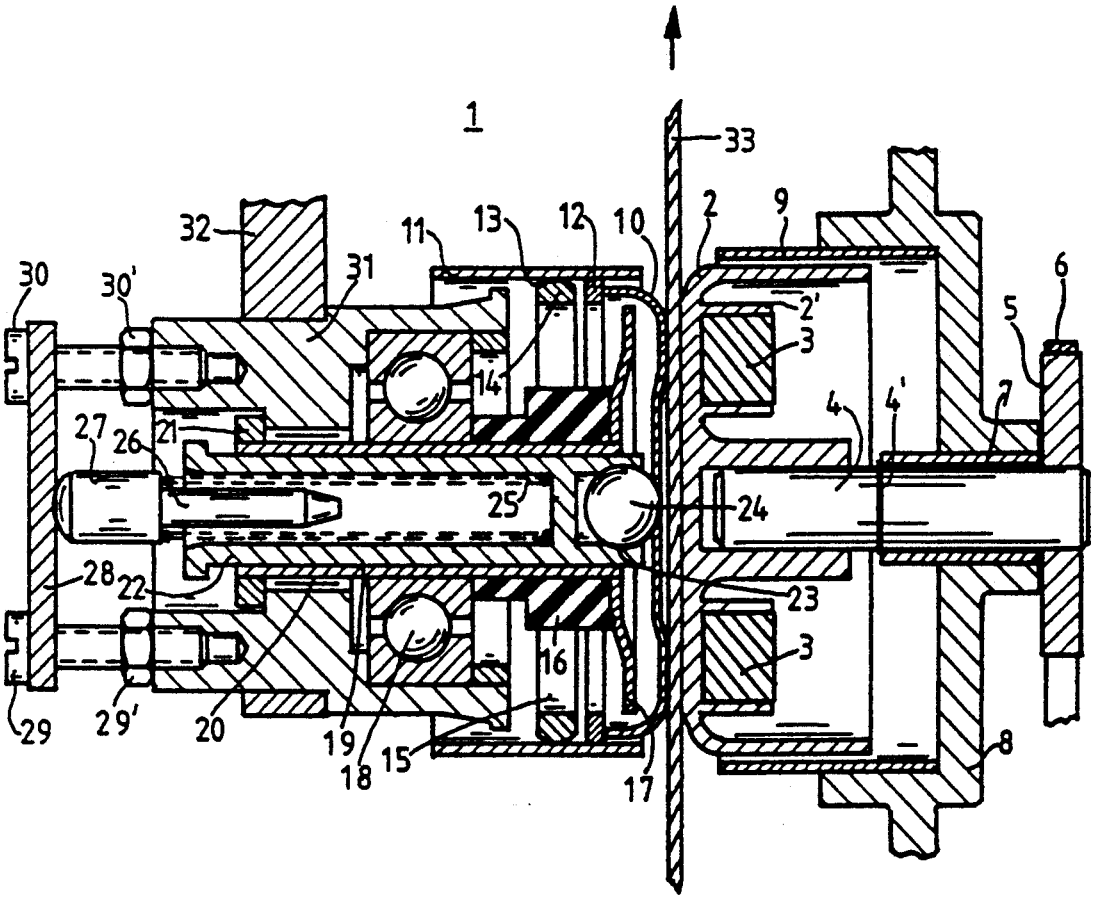
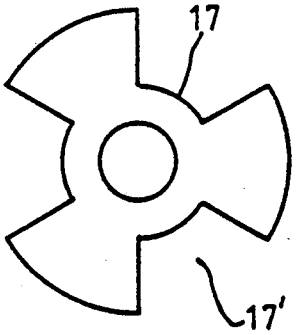
FIG.1b
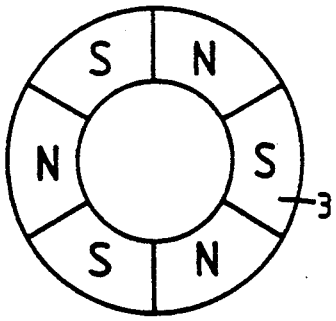
FIG.1a

ROTATIONALLY DRIVEN BRAKE DISK ARRANGEMENT OF A YARN TENSIONING DEVICE

FIELD OF THE INVENTION

The present invention relates to a rotationally driven brake disk arrangement for a textile yarn tensioning device.

BACKGROUND OF THE INVENTION

In disk-type braking arrangements in textile yarn tensioning devices, to avoid rapid wear of the surface of the brake disk from the traveling yarn, on the one hand, and to avoid the accumulation of lint or dirt between the brake disks, on the other hand, the brake disks are typically driven to rotate counter to the direction of yarn travel. In order to be able to transmit this drive from one disk to the other, a widely used provision is a central shaft that penetrates both brake disks and simultaneously can act as a cable-type friction brake.

A disadvantage of this arrangement is that fibers and yarns can wrap around this shaft, and that the shaft or its lining, if it is additionally used as a cable-type friction brake, tends to become scored by the yarn over the course of time and hence rendered useless. Up to that time, the braking values vary gradually, causing a gradual deviation from the desired yarn tension values.

In German Patent Document DE 33 29 644 A1, for instance, a yarn tensioning device that does not have this kind of central shaft is described. To be capable of transmitting the rotation of one brake disk to the other, however, this known apparatus has a set of gears that is relatively complicated and expensive.

SUMMARY OF THE INVENTION

It is therefore the object of the present invention to provide a rotationally driven brake disk arrangement of a yarn tensioning device that, without using a central shaft connecting two opposing brake disks, makes it possible in a simple way to transmit the rotary motion from one brake disk to the other.

The foregoing object may be achieved in accordance with the present invention by differing embodiments. In each embodiment, the rotationally driven brake disk arrangement includes first and second brake disks arranged in opposed facing relation, with suitable means being provided for exerting a variable force for pressing at least one of the brake disks toward the other. In one embodiment, a magnet is concentrically connected to the first brake disk and secured against relative rotation with respect thereto, while a body of hysteresis material is concentrically connected to the second brake disk and secured against relative rotation with respect thereto. The brake disk or disks which are acted upon by the variable pressing force comprises a nonmagnetic material and is movable axially relative to the magnetic body or the body of hysteresis material which is respectively associated with such brake disk. In another embodiment, a magnet is concentrically connected to each brake disk and secured against relative rotation with respect thereto.

The selective pairing of magnets or of magnetic and hysteresis material produces a transmission of the rotary motion of one brake disk to the other without requiring the use of a separate set of gears. It is especially significant that the force of attraction exerted by the magnet or magnets does not affect the mutual force of the brake disks pressing on a yarn traveling therebetween. As a result, the pressing force of the disks can be generated entirely independently of the rotary motion. The mutual spacing of the magnet rings associated with the two brake disks, or between the magnet ring and the body of hysteresis material, is always the same, regardless of the brake disk deflection. The use of a nonmagnetic material at least for the brake disk which is acted upon by a variable pressing force assures that the magnetic field will not affect the disks' pressing force. As a result, it is also possible to greatly reduce the braking force of the yarn tensioning device, which may be necessary in winding machines upon unwinding the last third of the cop, for example. This reduced braking force does not influence the magnetic force required for adequate transmission of the rotary motion.

Preferably, in each embodiment of the present invention, the magnet connected to one or both brake disks is formed in sectors of alternating polarity and demarcated from one another. In the first aforementioned embodiment, the body of hysteresis material connected to the second brake disk is formed with at least two circumferentially-spaced recesses, preferably of a number about half the number of the sectors of the magnet. In either case, the brake disk which is not acted upon by the variable pressing force and is not axially movable has a retainer for detachably mounting the magnet or the body of hysteresis material associated with such brake disk, as the case may be, on its side facing away from the one axially-movable brake disk.

The use of a magnet arrangement of demarcated sectors of alternating polarity assures the development of magnetic fields that are especially suitable for transmitting the rotary motion between the brake disks. The arrangement of recesses in the body of hysteresis material, in an embodiment having a magnet body and a body of hysteresis material, can produce corresponding results, because the parts of the body of hysteresis material located between the recesses effect a concentration of the magnetic flux. This effect is best obtained if the number of recesses equals half the number of magnet sectors.

Detachably mounting the magnet arrangement or the arrangement of hysteresis material, for instance on the brake disk, is advantageous so that, when a brake disk is changed because it has worn, the magnet arrangement or hysteresis material arrangement can be re-used.

BRIEF DESCRIPTION OF THE DRAWINGS

FIG. 1 is a sectional view through a brake disk arrangement according to the present invention, with spring-loaded brake disk;

FIG. 1*a* is an elevation of a magnet ring which is subdivided into sectors;

FIG. 1*b* is an elevation of a body of hysteresis material with recesses;

DESCRIPTION OF THE PREFERRED EMBODIMENT

Figure 2:
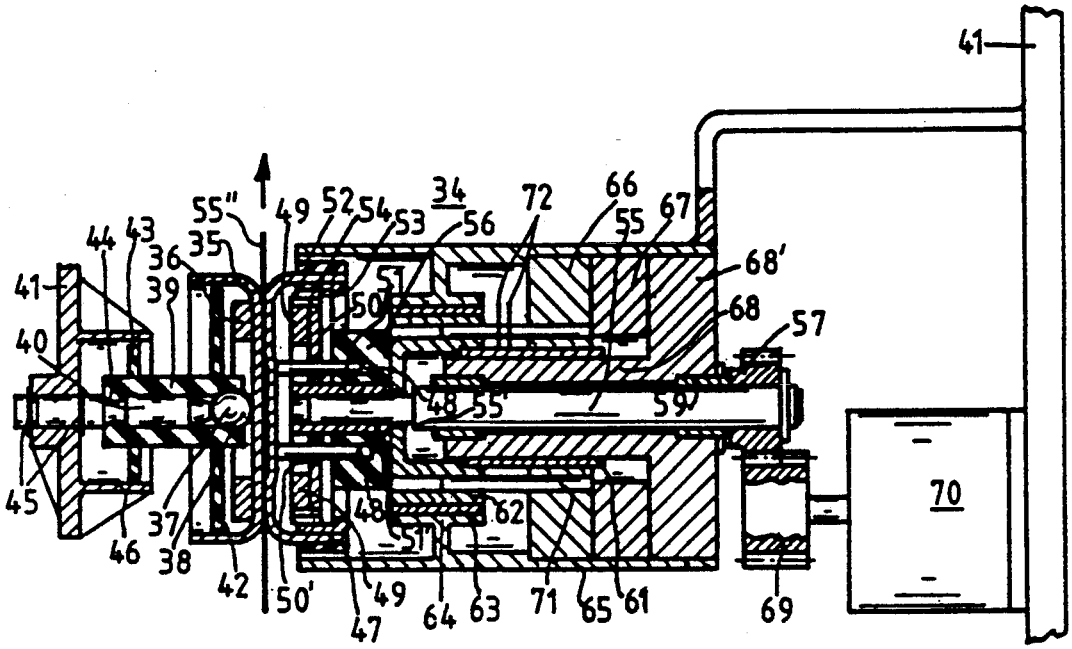
FIG. 2 shows a variant of a brake disk arrangement according to the present invention, having a brake disk that is pressure-loaded by means of a plunger coil and having a displaceable drive shaft.
Figure 2A:
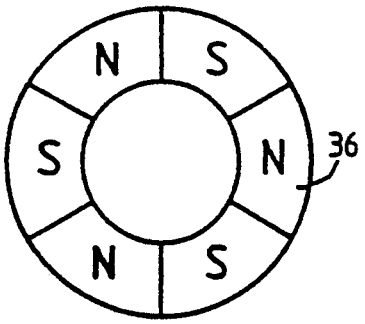
FIGS. 2*a* and 2*b* are elevations of the magnetic rings of FIG. 2, which are subdivided into sectors.
Figure 2B:
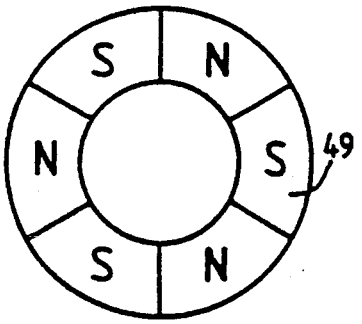

The yarn tensioning device 1 of FIG. 1 has two brake disks 2 and 10, between which the yarn 33 travels. The brake disk 2 is fixedly connected to a drive shaft 4, for example by a press fit. The drive shaft 4 is supported in a slide bearing 7 and simultaneously secured against displacement in the direction of its axis of rotation by a retaining ring 4' attached to the shaft 4 at one end of the bearing 7 and by the contact of the opposite end of the slide bearing 7 either with a pulley 5 attached to the outer end of the shaft 4 or with a sleevelike attachment portion 8' of the retainer 8. This structure also unequivocally defines the position of the brake disk 2. By means of a ring 9 inserted into the retainer 8, the entry of lint or other kinds of dirt or debris is essentially prevented.

The brake disk 2, in turn, has an annular interior retainer 2' into which a magnet ring 3 is inserted. This magnet ring 3 has sectors of equal size, of alternating polarity, as shown in further detail in FIG. 1*a*.

A drive belt 6 extends about the pulley 5 and is connected with a suitable drive mechanism (not shown) for transmitting rotation to the brake disks 2,10.

The opposite brake disk 10 is fixedly connected centrally to a ball 24 which is slidingly supported on a ball socket 23 machined into the forward end of a plastic pressing plunger 22.

As a result of this ball-and-socket joint, formed by the socket 23 and the ball 24, the brake disk 10 is essentially movable in all directions. Moreover, the desired pressing force is transmitted axially to the brake disk 10 by the pressing plunger 22 via the ball 24.

Protruding into a longitudinal bore of the pressing plunger 22 is a compression spring 25, which is supported on its other end against a tappet 27. The tappet 27 has on its front end a guide rod 26 that serves to guide the compression spring 25. A plate 28 is adjustably disposed in engagement with the opposite head end of the tappet 27. The position of this plate 28 is defined by two check screws 29 and 30, which in turn are secured with nuts 29' and 30' to a housing 31. This position of the plate 28 determines the pressing force of the brake disk 10 against the stationary brake disk 2, and thus determines the braking action on the yarn 33 traveling between the two brake disks 2,10. By means of the check screws 29 and 30, it is accordingly simple to regulate the braking force. An adjustment by means of one check screw, however, is also possible, for instance if the other check screw is replaced by a hinge or if the check screw acts directly, e.g., centrally, upon the tappet 27.

The pressing plunger 22 is supported for longitudinal displacement in a slide bearing 19, which in turn is secured against displacement in the direction toward the brake disk 10 by means of stop ring 21 fixedly connected to one end of the bearing to engage an interior shoulder of the housing 31. The displacement of the slide bearing 19 in the opposite direction is prevented by a relative soft iron plate 17 that is connected to a support sleeve 16 which fits over the opposite end of the slide bearing 19. The support sleeve 16 is supported against the inner race of a ball bearing assembly 18 that is secured in the housing 31.

To effectively prevent canting of the slide bearing 19, a spacer ring 20 is inserted into the air gap between the slide bearing 19 and the housing 31. The housing 31 itself is joined to a machine frame (not shown) by a support member 32.

The brake disk 10 is fixedly connected to a drumlike cylindrical brake disk holder 11 via a fastening ring 12. This brake disk holder 11 has a set of internal teeth 13, with which drive teeth 14 of a driver disk 15 mesh. The driver disk 15 in turn is connected fixedly to the support sleeve 16. In this way, a rotary motion can be transmitted to the brake disk holder 11 and thus to the brake disk 10 by the driver disk 15, without this connection being a hindrance to axial motion of the brake disk 10. The drive teeth 14 are rounded on their outer edge, so that canting of the brake disk holder 11 is also possible, without causing jamming of the meshing parts.

Once the imposition of the braking force to the disks 2,10 has been explained, the operation of transmitting the rotary motion from the brake disk 2 to the brake disk 10 will be explained hereinafter. The rotary motion transmitted via the belt 6 to the pulley 5 and therefrom to the drive shaft 4 causes the rotational driving of the brake disk 2 because of the press fit of the brake disk 2 on this drive shaft 4. The ring magnet 3, which is joined to the brake disk so as to be fixed against relative rotation, generates a magnetic field that migrates in accordance with the rotary motion of the brake disk 2, by means of the magnet's sectors of differing polarity. It is advantageous but not absolutely necessary for the sectors of differing polarity to have the same dimensions.

The permanent magnet field beginning at the ring magnet 3 generates a magnetic field of opposite polarity and the same pattern as in the sector arrangement of the ring magnet 3 in the soft iron plate 17 associated with the opposite brake disk 10. Since soft iron is a hysteresis material of high coercivity, this magnetization is relatively stable. As a result, the rotary motion of the ring magnet 3 and the brake disk 2 achieves not only a continuous reversal of magnetization of the soft iron plate 17 but also rotary driving of the iron plate 17. To further reinforce this effect, the soft iron plate 17 may have circumferentially-spaced sectorlike recesses 17', as shown in FIG. 1*b*, which face the ring magnet 3 and are adapted to the pattern of sector distribution of the ring magnet 3. Since the magnetic flux concentrates on the sectors of the soft iron plate located between the recesses, an even stronger driving force acts through the migrating magnetic field.

As already described, the soft iron plate 17 is firmly connected to the support sleeve 16, which in turn is firmly connected to the inner race of the ball bearing 18. Since the outer race of the ball bearing 18 is fixedly connected to the interior of the housing 31, the position of the soft iron plate 17 is defined independently of the axial position of the pressing plunger 22, the ball 24, and hence the brake disk 10. Canting of the brake disk 10 or its axial motion accordingly does not affect the soft iron plate 17. Since the position of the brake disk 2 is also fixedly defined, the mutual spacing between the magnet ring 3 and soft iron plate 17 does not vary during the operation of the yarn tensioning device 1.

The brake disk 10 comprises a nonmagnetic material, such as a hard chromium-plated sheet bronze. The magnetic field existing between the magnet ring 3 and the soft iron plate 17 thus exerts no influence whatever upon the brake disk 10, which accordingly is pressed against the opposite brake disk 2 solely by the force of the compression spring 25. It is accordingly possible to adjust only the pressing force of the spring 25 by means of the check screws 29 and 30. The transmission of the rotary motion from the positionally fixed brake disk 2 to the brake disk 10 is therefore effected in a very simple and reliable way. The mobility of the brake disk 10 is unimpeded by the transmission of the rotary motion by the drive teeth 14, as already described.

FIG. 2 shows a variant of the present invention, in which the means for generation of the rotary motion of the disks and the means for generation of the pressing force between the disks are located on one side of the yarn tensioning device 34. The brake disk 35 that is fixed in its position will be described first, along with its associated components that retain it.

This brake disk 35 is pivotably supported, via a ball 37 firmly connected to it, in a ball socket 38 of a plastic bushing 39. On its end remote from the ball 37, the plastic bushing 39 fits over a clamping groove 44 of a shaft 40. This shaft 40 is inserted into a retainer 41 and is optionally additionally fixed in position by securing rings 45. Advantageously, the shaft 40 is fitted into the retainer 41 by a press-fit. A sleeve 46 is fixedly connected to the retainer 41 and encloses, with a slight annular spacing, a radially-extending support disk 43 of the plastic bushing 39. This support disk 43 is intended to counteract canting of the shaft 40 that might occur under relatively heavy loads, which is accomplished by supporting the disk 43 on the inner wall of the sleeve 46 when such conditions occur. Another support disk 42 extending radially from the bushing 39 performs a similar function, i.e., the support disk 42 is intended to prevent major canting of the brake disk 35 supported in the ball and socket joint 37,38. A magnet ring 36 is fastened to the inner surface of the brake disk 35, e.g., by glue or another adhesive as an alternative to the detachable retention of the previously described embodiment.

In contrast to the previous embodiment of FIG. 1, however, a magnet ring 49 is also associated with the opposite brake disk 47, the structure of the magnet ring 49 being similar to that of the magnet ring 36. This magnet ring 49 is secured to a drive plate 50 having drive teeth 54 which mesh with a set of internal teeth 53 of a support ring 52. The brake disk 47 is inserted firmly into an annular slot in this support ring 52. The engagement between the internal teeth 53 and the drive teeth 54 is selected to be analogous to that of the teeth 13,14 of the first embodiment, resulting in free mobility of the brake disk 47 in the axial direction.

Here, by way of example, the brake disk 47 is retained by four support pins 48 which are press-fitted into a support disk 56 and pass through openings 50' of the drive plate 50, the openings 50' being selected to be large enough that they do not hinder tilting motion of the brake disk 47 that might be caused by the traveling yarn.

A drive shaft 55 is inserted into slide bearings 59 and 60 supported inside a bearing bushing 68 to enable the shaft 55 to be axially displaceable. The shaft 55 has a shoulder 55', which is adjoined by a reduced diameter shaft end 55''. A sleeve 51 is fixedly connected over the shaft end 55'', for example, by being shrunk thereon, and this sleeve 51 carries the drive plate 50. As a result, the rotary motion of the drive shaft 55 (described hereinafter) is transmitted to the drive plate 50 and consequently to the brake disk 47. Because of the rotary motion of the brake disk 47, which is held by the support pins 48, this rotary motion is further transmitted to the support disk 56.

One end of a cup-shaped coil retainer 62 is in face-abutting engagement with the support disk 56 and its opposite end carries a plunger 61 wound with a coil winding. This plunger coil 61, with the coil retainer 62, is not intended to participate in the rotary motion of the support disk 56, and there is therefore only a sliding contact between the two which is facilitated, for instance, in that the support disk 56 is made from a plastic while the coil retainer 62 is of metal.

To prevent the rotation of the plunger 61 and the coil retainer 62, rotation-securing pins 71 are inserted into bores of the coil retainer 62 with the other ends of the pins 71 being secured in a pole ring 66, which in turn is fixedly disposed in a housing 65.

In order to be centered, the coil retainer 62 is supported within a centering ring 64, which is formed as a part of the housing 65, via an annular slide bearing 63.

The cup-shaped coil retainer 62 has a central bore, which is larger than the diameter of the shaft end 55'' of the drive shaft 55, and because of the resultant spacing therebetween, the rotary motion of the drive shaft 55 is not transmitted to the coil retainer 62.

The coil of the plunger 61 is connected via electrical leads 72 to a controller (not shown) to energize the plunger coil 61 which is intended to regulate the pressing force of the brake disk 47 and hence to regulate the yarn tension. A controller of this kind may be controlled by a yarn tension sensor, for example, as a result of which fluctuations in the yarn tension can be compensated in a simple fashion. This plunger 61 thus serves the function of the compression spring 55 described in the first exemplary embodiment. In this case, however, the capability of continuous automatic control exists. Besides compensation for short-term fluctuations in yarn tension, a longer-tern influence on the yarn tension can also be exerted. This kind of yarn tension control can be performed in a winding machine if the gradually increasing yarn tension upon unwinding the last third of a cop, for example, is to be compensated for.

This regulation of the yarn tension is also completely independent of the transmission of the rotary motion from one side of the tension device to the other. Thus, the position of the sleeve 51 that carries the drive plate 50 is independent of the position of the plunger 61 that transmits the pressing force to the brake disk 47 via the coil retainer 62, the support disk 56, and the support pins 48. To this end, adequate spacing is provided between the sleeve 51 and the support disk 56 so that the support disk 56 may slide on the sleeve 51. The two magnet rings 36 and 49 generate a mutual force of attraction such that driving of the sleeve 51 by the drive shaft 55 firmly connected to it is effected, up to the forwardmost position of the drive shaft 55 shown. This forwardmost position of the shaft 55 is defined when a gear wheel 57 fixed to the opposite end of the shaft 55 abuts a spacer disk 58.

Since the support pins 48 also have adequate spacing inside the openings 50' of the drive plate 50, they do not transmit the axial motion of the support plate 56 to this drive plate 50.

The gear wheel 57 meshes with a drive pinion 69, which is correspondingly wider in axial dimension than the gear wheel 57. As a result, the drive pinion 69 can transmit rotary motion to the shaft 55 independently of the axial position of the drive shaft 55. The drive pinion 69 is secured to a drive shaft of an electric motor 70.

The plunger 61 surrounds the bearing bushing 68, forming an annular air gap therebetween. The bearing bushing 68 merges at its rear end with a pole disk 68', which is secured in the housing 65. In front of the pole disk 68, a ring magnet 67 with axial polarization is likewise fixedly disposed in the housing 65. In front of this ring magnet 67, the pole ring 66 is likewise secured in the housing 65. The pole ring 66 surrounds the plunger 61, likewise forming an annular gap therebetween. The magnetic field beginning at the ring magnet 67 generates a magnetic flux through the pole plate 68', the bearing bushing 68 via the air gap in which the plunger 61 is disposed, and the pole ring 66, extending as far as the opposite side of the ring magnet 67. The material from which the pole ring 66, the bearing bushing 68, and its pole disk 68' are made has very good magnetic properties (soft iron, for example), and therefore a relatively strong magnetic flux is generated, which passes through the air gap in which the plunger 61 is disposed. A strong exertion of force upon the plunger 61 therefore takes place and is easily controlled by the coil current delivered to the coil of the plunger 61. This exertion of force can be selectively controlled in both directions by the direction of the coil current, so that no mechanical restoring elements are required.

By the use of two magnet rings 36,49, a strong driving force for transmitting the rotary motion to the brake disk 35 is generated. The two magnet rings 36,49 automatically adjust in such a way that sectors of opposite polarity face one another.

If the yarn tensioning device 34 is to be opened, then a lever (not shown) may engage the drive shaft 55 and displace it rearward, or in other words, toward the electric motor 70. In the process, the coil retainer 62 is carried along in the axial direction of the drive shaft 55, both by the drive plate 50 as a result of its contact with the support disk 56 and by the contact of the edge 51' of the sleeve 51 with the front end of the coil retainer 62. However, it is advantageous, by reversing the plunger coil current via the leads 60, to displace the plunger toward the right (as viewed in FIG. 2) causing the coil retainer 62 to strike the shoulder 55' of the drive shaft 55 and carry the shaft with it. The corresponding movement of the other parts is effected via the sleeve 51, in the manner already described.

Figure 3:
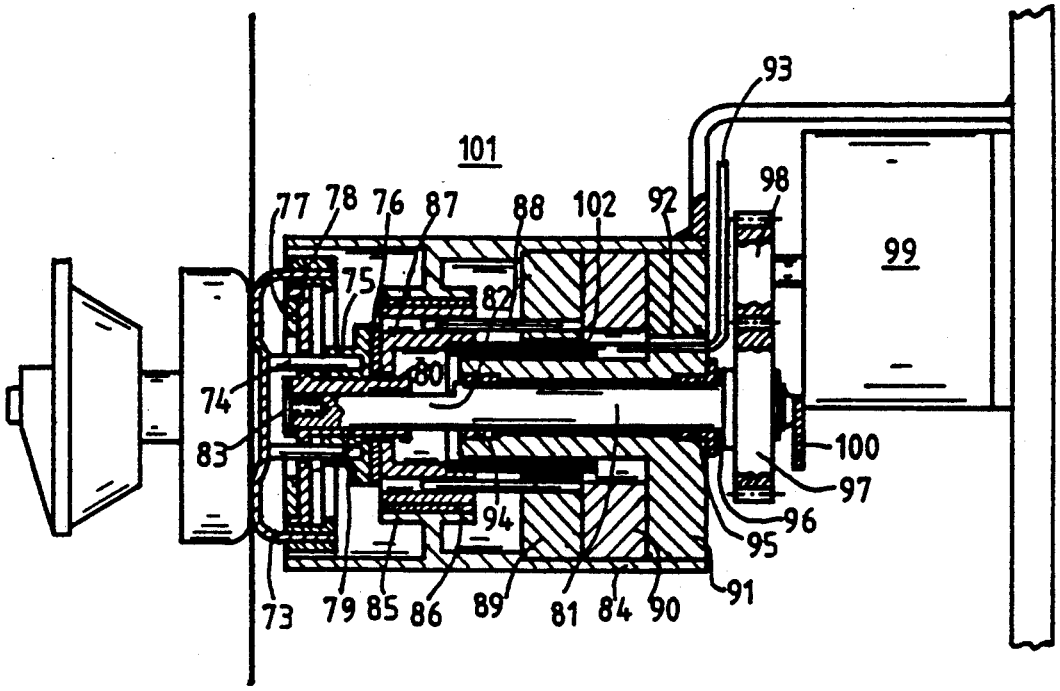
FIG. 3 shows a variant of the brake disk arrangement of FIG. 2, with a fixedly disposed drive shaft.

The yarn tensioning device 101 shown in FIG. 3 has a stationary drive shaft 81. On its front end oriented toward the brake disk 73, this drive shaft 81 is axially shouldered on one circumferential side to produce a flattened portion 82. The flattened portion 82 of the shaft 81 serves to carry a metal bushing 79, whose inside cross section matches the shape of the shoulder 82 of the drive shaft 81. The bushing 79 is also secured against longitudinal displacement by means of a stop screw 83.

A drive disk 78 on which a magnet ring 77 is secured is connected directly to the bushing 79. The embodiment of the magnet ring 77 and the cooperation between the drive disk 78 and the support ring for the brake disk 73 are as in the preceding exemplary embodiments and therefore need not be described in detail here. Support pins 74 for the brake disk 73 extend through openings in the drive disk 78 and allow adequate relative movement of the brake disk 73.

A plastic support sleeve 75 is slidably disposed on the metal bushing 79 and, as a result, is axially displaceable thereon. A plastic retainer 87 for a coil plunger 102 also surrounds the bushing 79. Disposed between the support sleeve 75 and the retainer 87 is a metal disk 76, which is intended to enable easier sliding of the support sleeve 75 on the bushing 79, the latter being stationary in contrast to the support sleeve 75.

The retainer 87 is secured against rotation by rotation-securing pins 88, which are secured in a stationary pole ring 89. The retainer 87 is secured against canting in a centering ring 85 via slide bearing ring 86, which is necessary in order to maintain the air gap in which the plunger 102 is disposed constant at all times.

The drive shaft 81 is supported in bearings 94 and 95 and is axially fixed by a spacer disk 96 and a displacement securing member 100. The shaft 81 is driven from an electric motor 99 via gear wheels 97 and 98.

To generate the magnetic field in which the coil plunger 102 is disposed, a ring magnet 90 is provided and is disposed between a bearing 91 forming a pole disk and a pole ring 89, as has already been described in further detail in the preceding embodiment. The coil of the plunger 102 is supplied with current via leads 93, and in this present embodiment, these leads extend through a bore 92 in the rear portion of the bearing 91 that forms a pole disk.

The magnet ring 77 is attracted by the opposite magnet ring (not shown) of the opposing brake disk causing the bushing 79 to be pulled toward the stop 83 of the axially fixed drive shaft 81. If the yarn tensioning device 101 is to be opened, the plunger 102 is supplied with an oppositely directed current via the leads 93. As a result, the plunger 102 and its retainer 87 are pulled to the right (as viewed in FIG. 3), while being kept centered by the centering ring 85. The central bore in the retainer 87 is large enough that the retainer normally has no contact with the surface of the bushing 79. When the retainer 87 is retracted, however, it strikes against one end edge 80 of the bushing 79 and carries the bushing 79 to the right with it. As a result, the drive disk 78 strikes the front edge of the support sleeve 75 and carries it along with it. Since the support sleeve 75 is joined to the brake disk 73 via the support pins 74, the brake disk 73 is retracted and the yarn tensioning device 101 is opened.

Compared with the previous embodiment, this variant has the advantage that the entire drive shaft 81 need not be moved lengthwise and that, via the magnetic action, only the bushing 79 needs to be pulled toward the stop 83 of the drive shaft 81.

In summary, it can be noted that, via the transmission of the rotary motion by magnetic forces, a very simple apparatus is created, with only very slight vulnerability to malfunction. Moreover, the braking force can be controlled independently of this transmission of the rotary motion. An especially advantageous control is obtained by using a coil plunger, which enables simple and quick yarn tension regulation or, optionally, the ability to control yarn tension by a tension sensor, for example. The possibility also exists of increasing the braking force enough that checking of the yarn tension can be done, for instance, in a winding machine. This kind of check of the yarn tension is especially useful if the strength of a yarn splice which has just been made is to be tested. To that end, a maximally high pressing force is generated, while the tearing force of the yarn can be ascertained with a yarn tension sensor (not shown).

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the present invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A rotationally driven brake disk arrangement for a yarn tensioning device, comprising:

first and second brake disks arranged in opposed facing relation;

a first body of hysteresis material concentrically connected to the first brake disk and secured against relative rotation with respect to the first brake disk, said first body of hysteresis material comprising a magnet;

a second body of hysteresis material concentrically connected to the second brake disk and secured against relative rotation with respect to the second brake disk;

means for exerting a variable force for pressing one of the first and second brake disks toward the other of the first and second brake disks; and the one brake disk comprising a nonmagnetic material and being movable axially relative to the respective body of hysteresis material associated with the one brake disk.

2. The rotationally driven brake disk arrangement of claim 1, wherein the magnet comprises sectors of alternating polarity and demarcated from one another.

3. The rotationally driven brake disk arrangement of claim 2, wherein the second body of hysteresis material has at least two circumferentially-spaced recesses.

4. The rotationally driven brake disk arrangement of claim 3, wherein the number of the recesses is half the number of the sectors of the magnet.

5. The rotationally driven brake disk arrangement of claim 1, wherein the second body of hysteresis material comprises a magnet.

6. The rotationally driven brake disk arrangement of claim 5, wherein each magnetic comprises sectors of alternating polarity and demarcated from one another.

7. The rotationally driven brake disk arrangement of claim 1, wherein the other brake disk has a retainer for detachably mounting the respective body of hysteresis material associated with the other brake disk on its side facing away from the one brake disk.

* * * * *